US006013885A

United States Patent [19]

Kowalczyk

[11] Patent Number: 6,013,885

[45] Date of Patent: Jan. 11, 2000

[54] ROCKER SWITCH WITH LAMP MODULE

[75] Inventor: Karen Kowalczyk, Southington, Conn.

[73] Assignee: Carlingswitch, Inc., Plainville, Conn.

[21] Appl. No.: 09/233,728

[22] Filed: Jan. 21, 1999

[51] Int. Cl.[7] ..... H01H 9/16; H01H 21/04

[52] U.S. Cl. ..... 200/315; 200/302.3; 200/339

[58] Field of Search ..... 200/4, 5 R, 6 R–6 C, 200/302.1, 302.3, 308, 313, 315, 317, 339

[56] References Cited

U.S. PATENT DOCUMENTS

| | | | |
|---|---|---|---|
| 4,340,791 | 7/1982 | Sorenson | 200/302 |
| 4,359,618 | 11/1982 | Stevens | 200/314 |
| 5,105,059 | 4/1992 | Sorenson et al. | 200/302.3 |
| 5,107,082 | 4/1992 | Valenzona | 200/292 |
| 5,451,733 | 9/1995 | Olson et al. | 200/315 |
| 5,660,270 | 8/1997 | Martin et al. | 200/315 |
| 5,743,382 | 4/1998 | Luo | 200/315 |
| 5,752,595 | 5/1998 | Fein et al. | 200/315 |
| 5,850,062 | 12/1998 | Botz et al. | 200/315 |

*Primary Examiner*—Michael Friedhofer
*Attorney, Agent, or Firm*—McCormick, Paulding & Huber LLP

[57] ABSTRACT

An electric switch housing comprises a generally downwardly open rectangular dielectric casing which has laterally spaced side walls and opposed end walls integrally connected at their adjacent vertical edges to form four corners. The casing has a top wall, which includes a raised center rib portion having laterally spaced sockets, and is integrally joined with the top edges of the side and end walls. The casing defines an integrally formed upwardly open cavity for receiving an actuator. The actuator has upper shoulder portions received in the laterally spaced sockets, and is pivotally received in the casing. A generally upwardly open rectangular dielectric base is received in the downwardly open casing, defining a switch cavity containing at least two terminals and at least one movable switch contact in the base. A lamp module is provided in the casing and is supported between the base and the casing. The lamp module has at least one clearance opening for receiving the pivotally movable actuator, and defines at least one lamp opening for receiving an electric lamp.

34 Claims, 8 Drawing Sheets

ROCKER SWITCH WITH LAMP MODULE

BACKGROUND OF THE INVENTION

The invention relates generally to electric switch housings, and deals more particularly with an environmentally sealed rocker switch housing containing a lamp module which is a separate component.

SUMMARY OF THE INVENTION

An electric switch housing comprises a generally downwardly open rectangular dielectric casing which has laterally spaced side walls and opposed end walls integrally connected at their adjacent vertical edges to form four corners. The casing has a top wall, which includes a raised center rib portion having laterally spaced sockets, and is integrally joined with the top edges of the side and end walls. The casing defines an integrally formed upwardly open cavity for receiving an actuator. The actuator has upper shoulder portions received in the laterally spaced sockets, and is pivotally received in the casing.

A generally upwardly open rectangular dielectric base is received in the downwardly open casing, defining a switch cavity containing at least two terminals and at least one movable switch contact in the base. A lamp module is provided in the casing and is supported between the base and the casing. The lamp module has at least one clearance opening for receiving the pivotally movable actuator, and defines at least one lamp opening for receiving an electric lamp.

An advantage of the present invention is that it is easier and quicker to manufacture and assemble than prior art switch structure. The present invention also provides a switch structure that is easier to change to meet customers' specifications concerning lamp configurations and lamp circuit design.

BRIEF DESCRIPTION OF THE DRAWINGS

A more complete understanding of the invention and many of its attendant advantages will be readily appreciated as the same become better understood by reference to the following detailed description when considered in conjunction with the accompanying drawings wherein.

DETAIL DESCRIPTION

Figure 2:
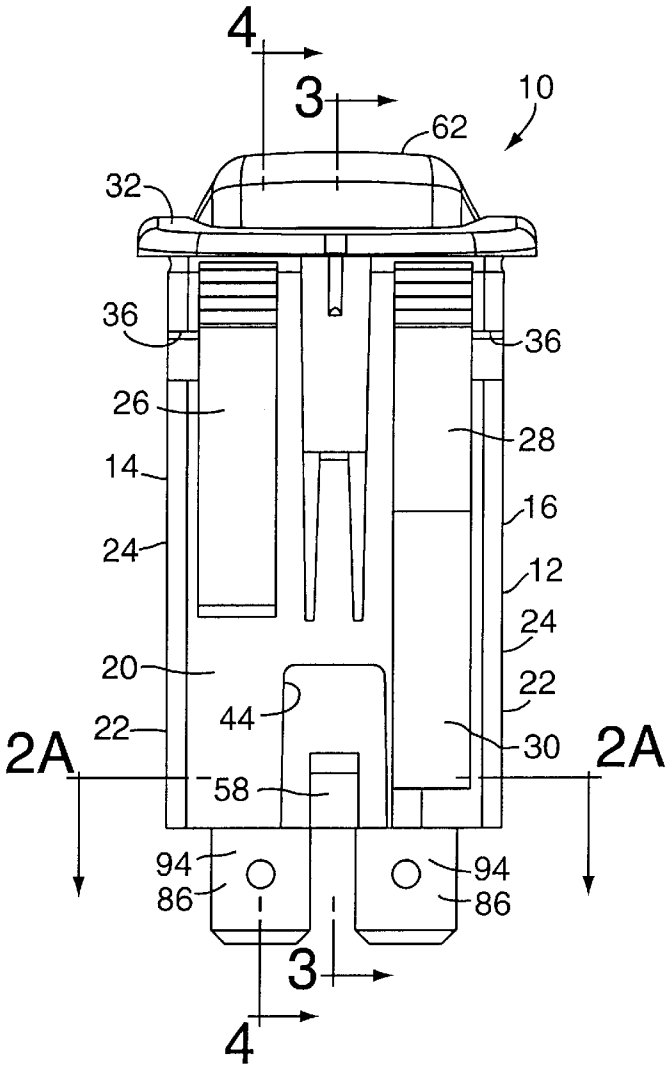
FIG. 2 is an elevational view taken generally on the line 2—2 of the rocker switch of FIG. 1.
Figure 1:
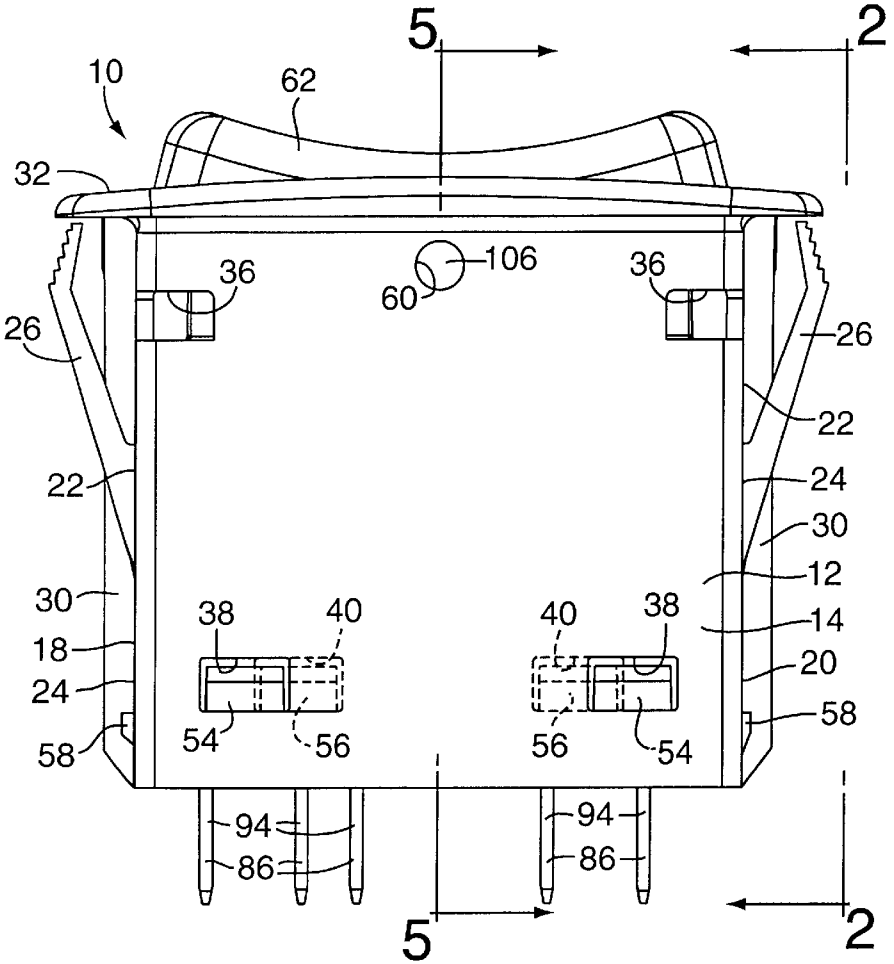
FIG. 1 is an elevational view of a rocker switch constructed in accordance with the present invention.
Figure 2A:
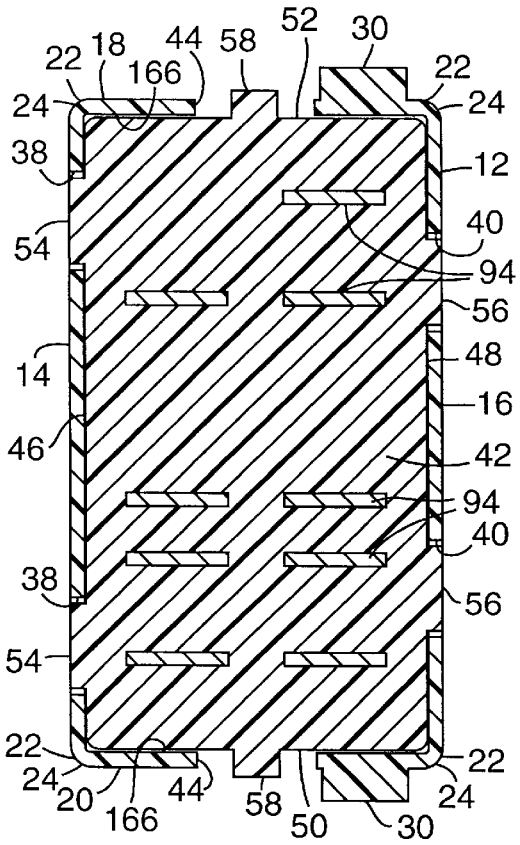
FIG. 2A is a sectional view taken generally on the line 2A—2A of the casing of FIG. 2.

Turning now to the drawings in greater detail, FIGS. 1, 2 and 2A show an electric switch housing 10 comprising a generally downwardly open rectangular dielectric casing 12 having laterally spaced side walls 14,16 and opposed end walls 18,20 integrally connected at their adjacent vertical edges 22 to form four corners 24. Each of the casing end walls 18,20 include two integrally formed resilient wings 26,28 which project laterally outward from the end walls in order to secure the switch housing in a switch panel (not shown). One 28 of the two wings 26,28 on each casing end wall 18,20 has a depending flange 30 which permits the switch housing 10 to be mounted into a switch panel (not shown) in only one orientation. This allows for the switch housing 10 to be installed with the correct polarization even if the installation is performed by touch only. For example, installation of the switch housing 10 into a switch panel sometimes must be performed without being able to see the installation. The casing 12 also includes a flange 32 surrounding the top of the casing 34 for limiting the positions in which the switch housing 10 can be installed. The casing 12 further includes ports 36 for assisting in keeping the switch housing 10 environmentally secure by allowing liquids to drain from the casing.

Still referring to FIGS. 1, 2 and 2A, each of the casing side walls 14,16 defines rectangular apertures 38,40 such that the apertures 38 on one side wall 14 are placed in different locations than on the apertures 40 on the other side wall 16 in order to mount the casing 12 to a base 42 in only one orientation. Each of the casing end walls 18,20 defines a rectangular slot 44 for mounting the casing 12 to the base 42. The base 42 includes side walls 46,48 and opposing end walls 50,52, and each side wall defines at least one projecting tab 54,56, and each end wall including at least one projecting tab 58. The end wall projecting tab 58 is adapted to be received in the casing end wall slot 44. The casing side wall apertures 38,40 are alignable with the base side wall projecting tabs 54,56 for securing the base 42 in assembled relation with the casing 12. Each of the casing side walls 14,16 also defines an opening 60,60 for pivotally coupling a rocker 62.

Figure 3:
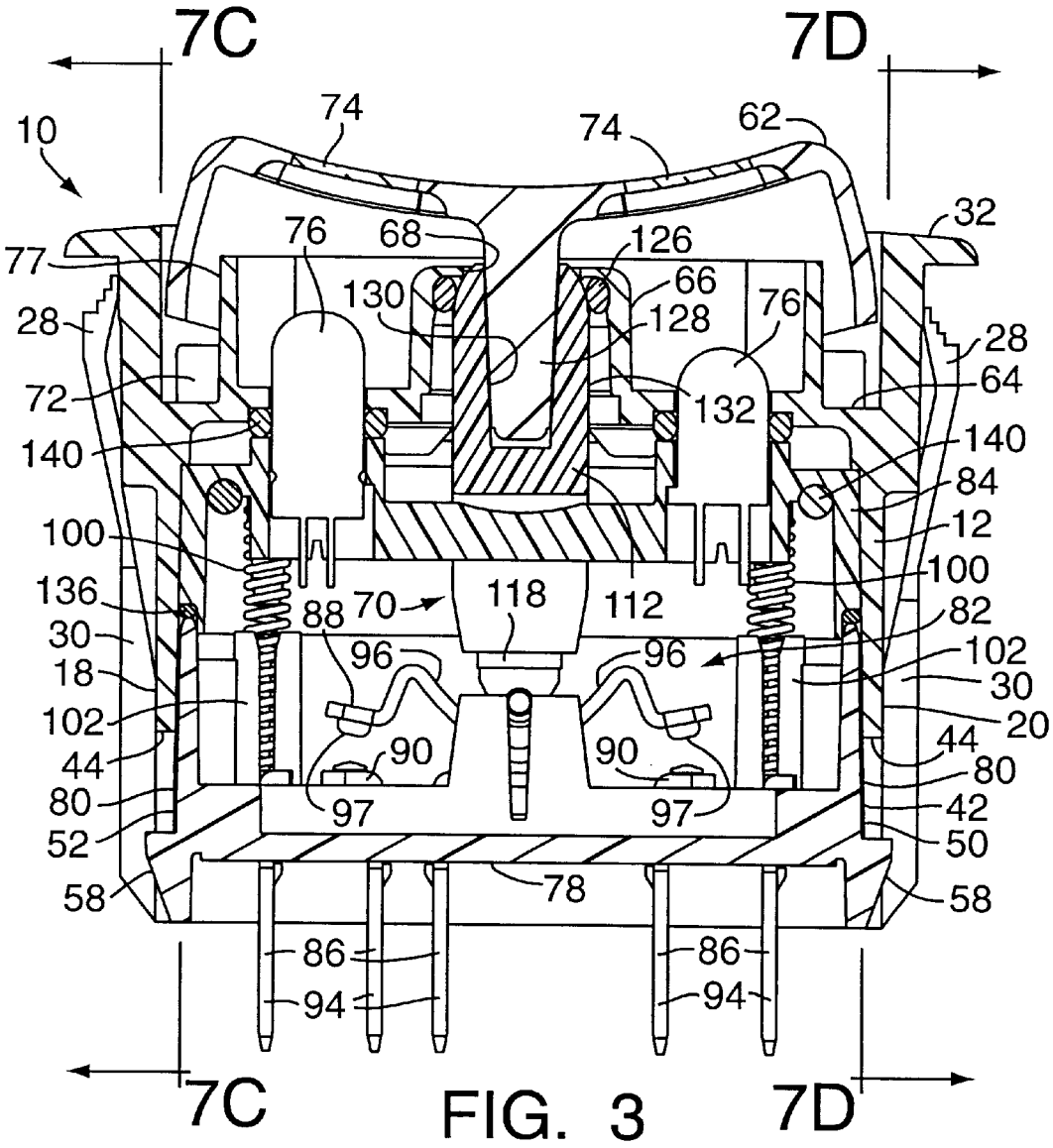
FIG. 3 is a sectional view taken generally on the line 3—3 of FIG.2.

As shown in FIG. 3, the casing 12 includes a top wall 64 integrally joined to the casing side 14,16 and end walls 18,20. The top wall of the casing 12 includes a raised center rib portion 66 and defines an integrally formed opening 68 for receiving an actuator means 70. The top wall also defines an upwardly open cavity 72 of generally rectangular configuration to receive the generally rectangular rocker 62 which is pivotally coupled to the casing 12. The rocker 62 may be provided with a transparent panel 74 or panels 74,74 for revealing illumination from at least one electric lamp 76, or other means of revealing the electric lamp 76 may be substituted, such as etching the rocker, without departing from the broader aspects of the present invention. Inside the rocker 62 provides space for a well 77 defined by the top wall 64 of the casing 12 in order to keep water away from the electric lamp 76.

Continuing with FIG. 3, the base 42 has a bottom wall 78 which is integrally joined to lower edges 80 of the base side 46,48 and end walls 50,52. The casing 12 and the base 42 define a switch cavity 82 into which is placed at least a lamp module 84, two terminals 86, a movable switch contact 88, and the actuator means 70. The bottom wall 78 of the base 42 includes conductive clips 90,92 which are adapted to receive terminals 86, such as spade terminals 94. The movable switch contact 88 is a pivoted lever and includes contact arms 96,96, each arm having a contact 97 for engaging one of the conductive clips 92 in the bottom wall 78 of the base 42. Thus the movable switch contact lever 88 pivots between three positions, an open position and at least one closed position. In the closed position, one of the contact arms 96 extends between a center conductive clip 90 on which the movable switch contact 88 pivots and one of the conductive clips 92. This switch structure provides a momentary double pole electric switch as shown and described. The present invention is not limited in this regard as other types of movable switch contacts designed for other types of electric switches, such as a relatively flat movable switch contact used in a three position single pole electric switch, may be substituted without departing from the broader aspects of the present invention.

Figure 4:
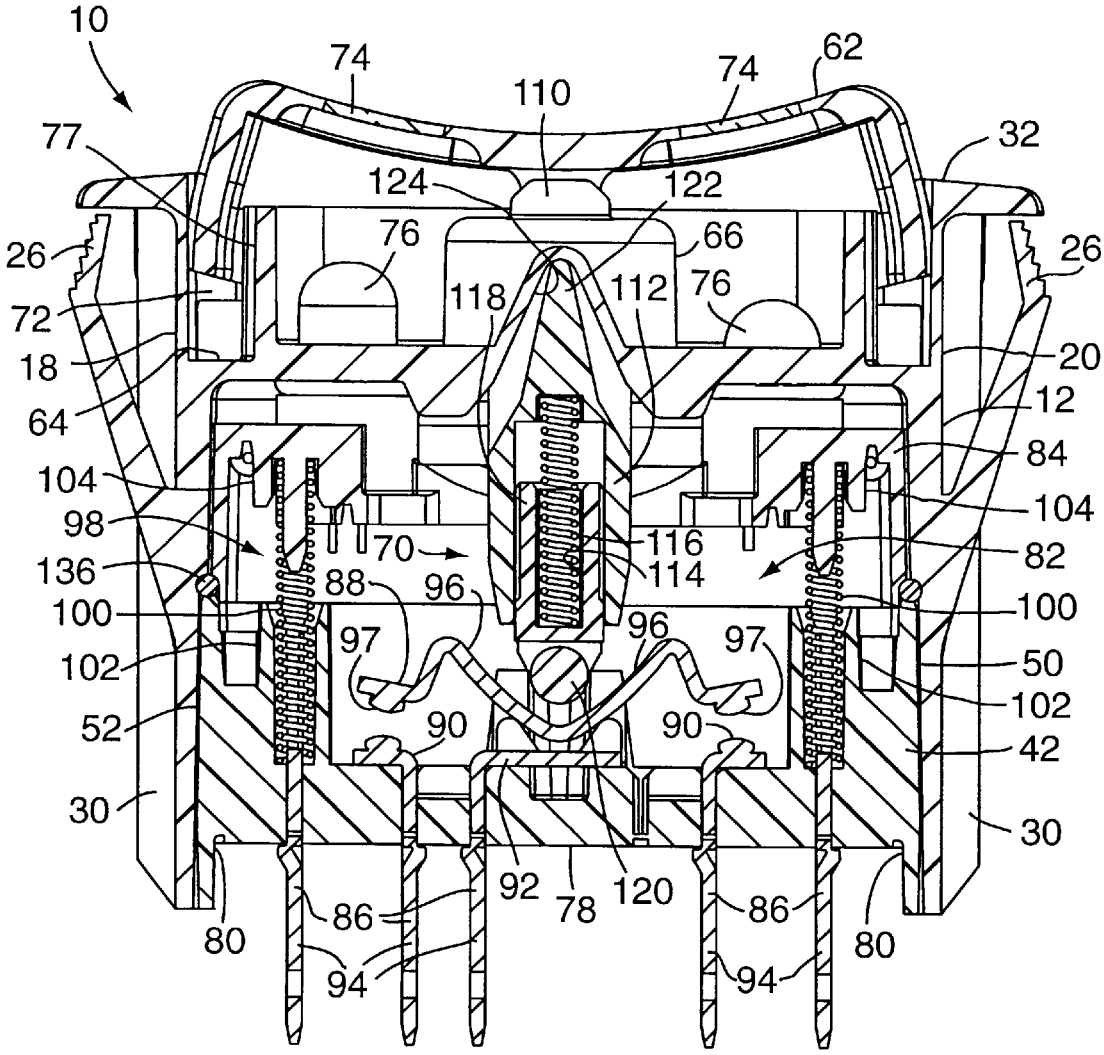
FIG. 4 is a sectional view taken generally on the line 4—4 of FIG. 2.

Referring to FIG. 4, conductive means 98 is provided for electrically connecting the lamp 76 to the terminals 86 in the base 42, such that part of the conductive means is provided in the lamp module 84 and part in the base. The conductive means 98 includes at least one coil spring 100 extending between upwardly open sockets 102 in the base 12 and integrally formed downwardly open sockets 104 in the lamp module 84.

Figure 5:
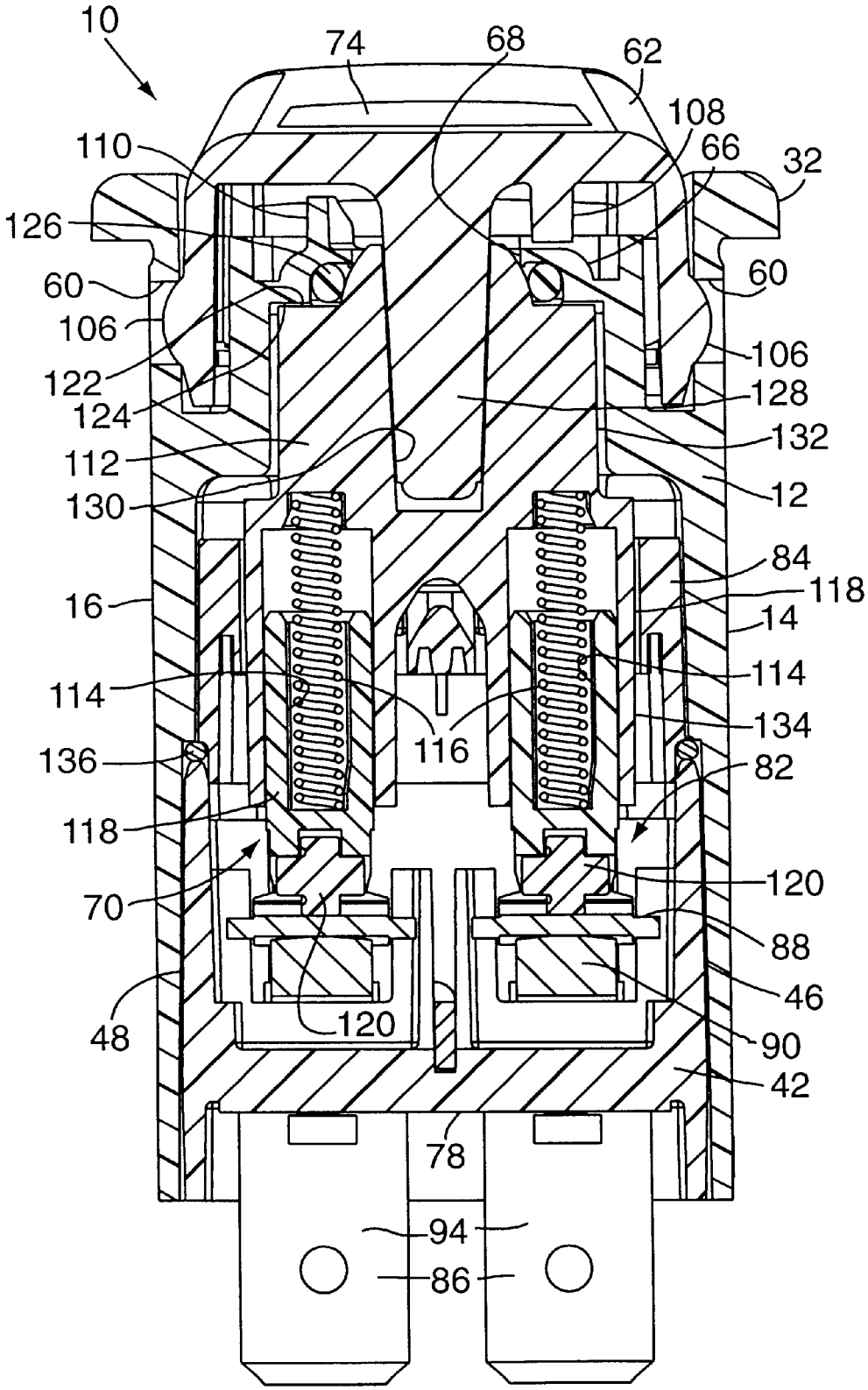
FIG. 5 is a sectional view taken generally on the line 5—5 of FIG. 1.

As shown in FIGS. 4 and 5, the rocker 62 is pivotally supported in the casing 12 by means of projecting tabs 106,106 which are received in aligned openings 60,60 provided for this purpose in the side walls 14,16 of the casing. The rocker 62 defines a downwardly protruding tab 108, and the center rib portion 66 of the top wall 64 of the casing 12 defines an upwardly protruding tab 110, such that these two tabs 108,110 insure that the rocker 62 can be assembled with the casing in only one orientation.

Referring to FIGS. 4 and 5, the actuator means 70 includes the rocker 62 and a pivotably movable actuator 112 which defines downwardly open plunger cavities 114 in which springs 116 and spring loaded plungers 118 position rotatably coupled rollers 120 for engaging the movable switch contact lever 88. The actuator 112 has upper shoulder portions 122 which are pivotally received in laterally spaced sockets 124 which are defined in the center rib portion 66 of the top wall 64 of the casing 12. There is also a seal 126 between the actuator 112 and the top wall 64 of the casing 12 for providing environmental isolation for the interior of the switch cavity 82.

Continuing with FIGS. 4 and 5, the rocker includes a rocker post 128 which is received in an actuator cavity 130 defined in an upper end 132 of the actuator 112. The actuator 112 includes a widened lower portion 134 in the double pole electric switch arrangement shown, and it is another feature of this actuator that its lateral width is such that the actuator will be restricted to pivotal movement only about an axis defined both by the spherical upper end portion 132 and more particularly by the axis of the aligned openings 60,60 in the casing 12 which receive the rocker 106,106, and by the shoulders 122 and sockets 124.

Figure 6:
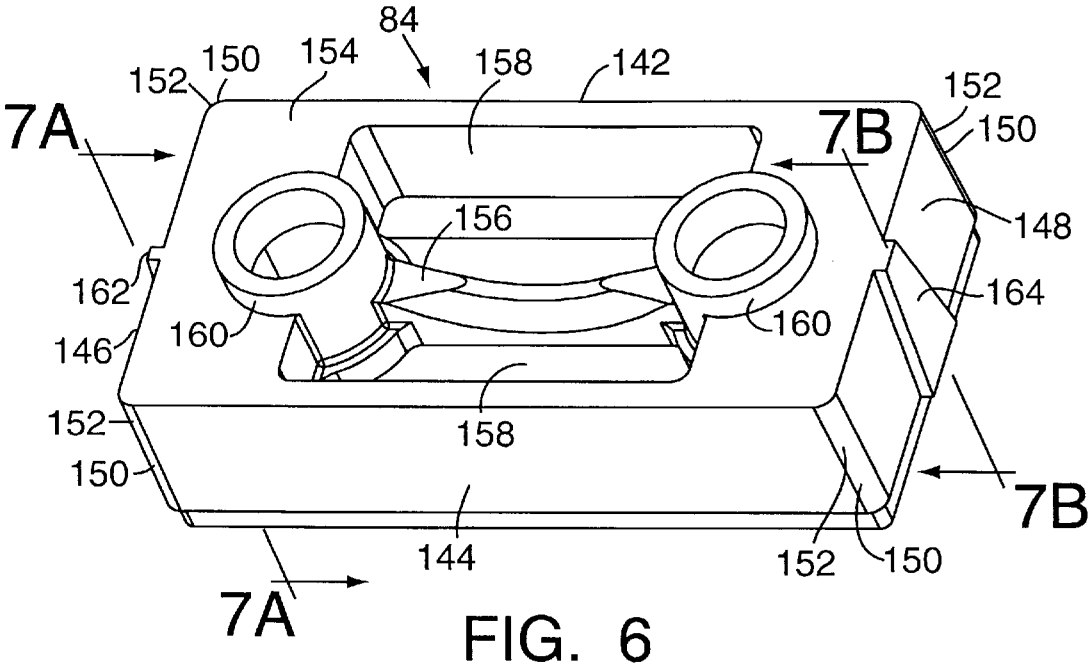
FIG. 6 is a perspective view of a lamp module employed by the rocker switch of FIG. 1.

As shown by FIGS. 4 and 5, the lamp module 84 is provided in the casing 12 and supported between the base 42 and the casing and includes a seal 136, preferably in the form of a gasket, between the base and the lamp module. An o-ring seal 140 is provided around each electric lamp 76 which is mounted in the lamp module 84 for providing environmental isolation of the electric lamp and the interior of the switch cavity 82. As shown in FIG. 6, the lamp module 84 is generally rectangular and of a dielectric material, and has laterally spaced side walls 142,144 and opposed end walls 146,148 integrally connected at their vertical edges 150 to form four corners 152. The lamp module 84 also has a top wall 154 which is integrally joined to the side 142,144 and end walls 146,148 and has a centrally positioned laterally extending bridge 156. The top wall 154 of the lamp module 84 defines at least one and preferably two clearance openings 158 for receiving the pivotally movable actuator 112, and at least one and preferably two lamp openings 160 for respectively receiving an electric lamp 76, preferably an LED.

Figure 7C:
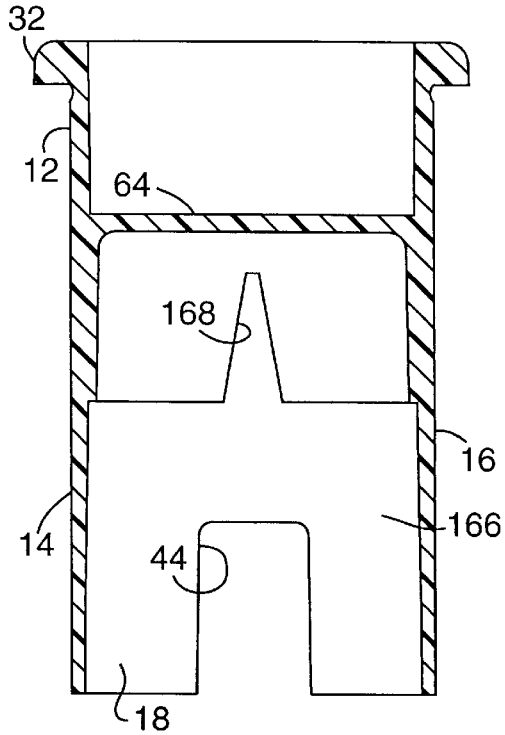
FIG. 7C is a sectional view taken generally on the line 7C—7C of FIG. 3.
Figure 7D:
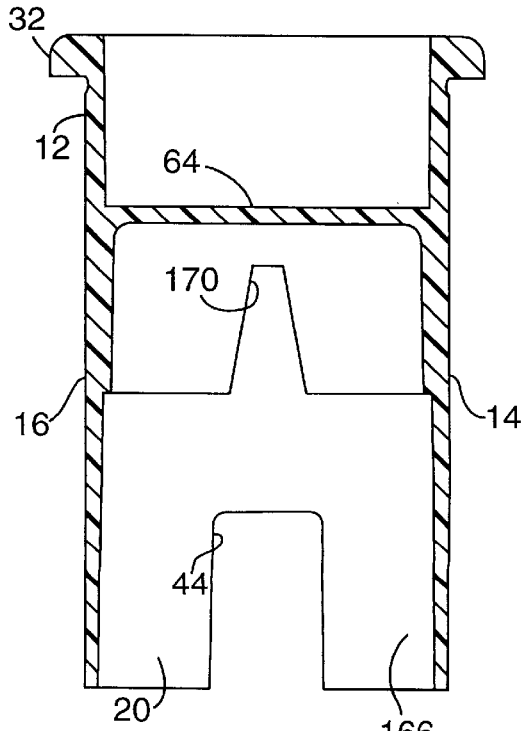
FIG. 7D is a sectional view taken generally on the line 7D—7D of FIG.3.
Figure 7A:
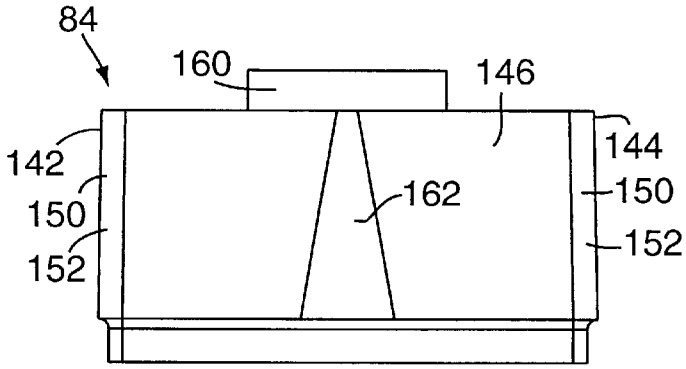
FIG. 7A is an elevational view taken generally on the line 7A—7A of the lamp module of FIG. 6.
Figure 7B:
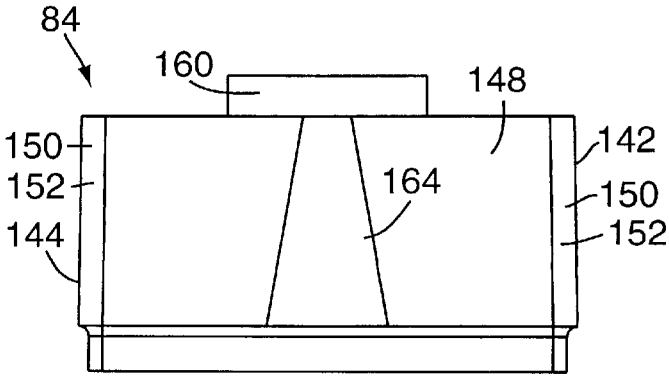
FIG. 7B is an elevational view taken generally on the line 7B—7B of the lamp module of FIG. 6.

As shown in FIGS. 7A and 7B, the end walls 146,148 of the lamp module 84 include protruding wedges 162,164, with each wedge having a different configuration. As shown in FIGS. 7C and 7D, the interior 166 of the end walls 18,20 of the casing 12 define wedge shaped slots 168,170 of respectively different configurations whereby the wedges 162,164 on the end wall 146,148 of the lamp module 84 can be inserted in only one orientation in the casing. While wedges and slots have been shown and described, the present invention is not limited in this regard as other ways of limiting the orientations at assembly, such as tabs on the casing interior walls and slots on the lamp module side walls, may be substituted without departing from the broader aspects of the present invention.

Figure 8:
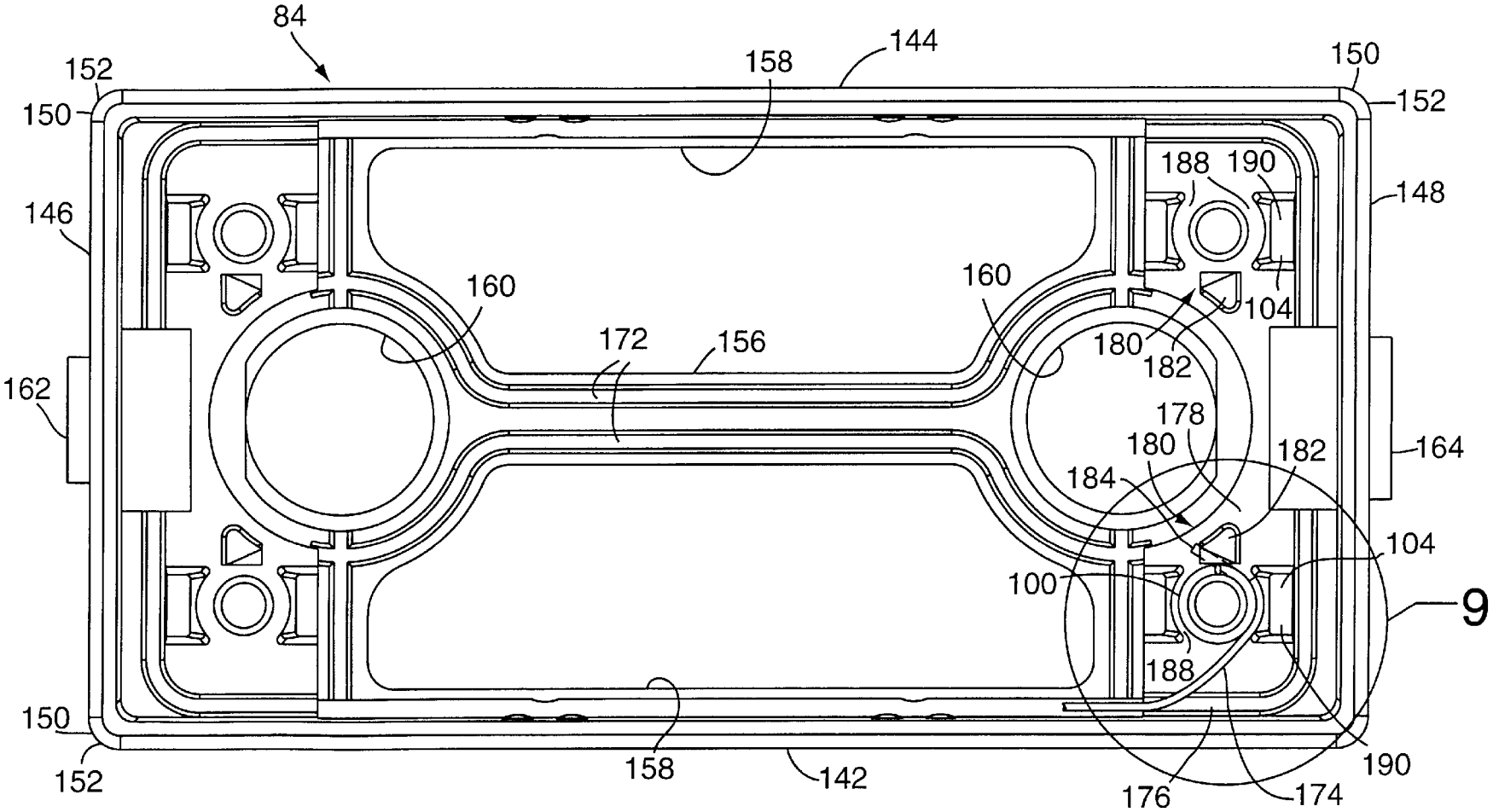
FIG. 8 is a bottom plan view of the lamp module of FIG. 6.
Figure 9:
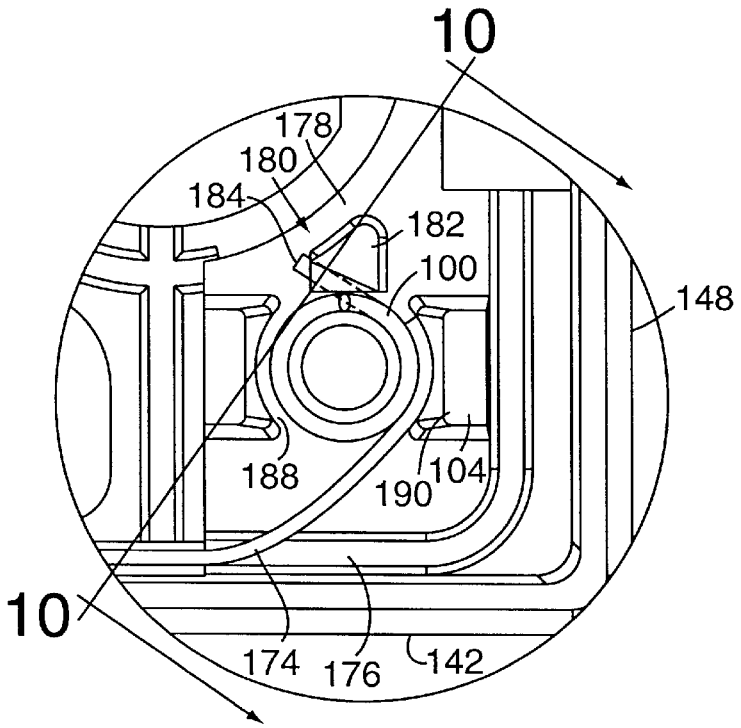
FIG. 9 is a fragmentary enlargement taken generally within the circle 9 of FIG. 8.
Figure 10:
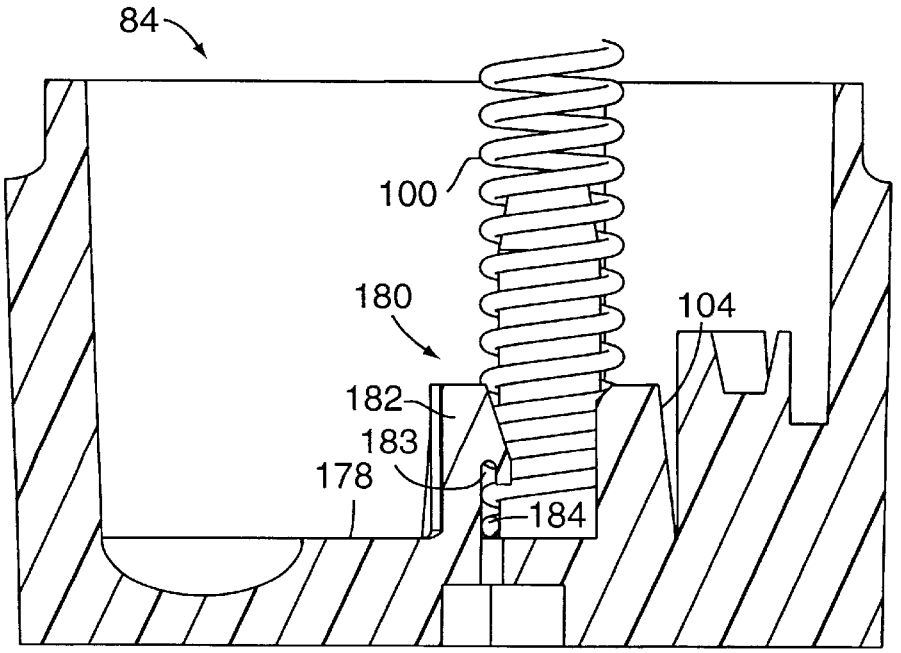
FIG. 10 is a partial plan view taken generally on the line 10—10 of FIG. 9.

Referring to FIG. 8, the lamp module bridge 156 defines at least one wire channel 172 for running wires 174 from the electric lamps 76 to the coil springs 100. Wire channels 176 also extend the circumferentially of the bottom 178 of the lamp module 84 and extend to the electric lamp openings 160. As shown in FIGS. 9 and 10, a retaining means 180 is provided to hold the coil spring 100 in abutting relation to at least one wire 174 which is attached to the electric lamp 76. The retaining means 180 includes a retaining clip 182 defined by the bottom 178 of the lamp module 84 which defines a recess 183 for gripping the end 184 of the coil spring 100 so that the coil spring does not become separated from the wire 174 if the lamp module is turned over during assembly of the switch housing 10. While a retaining clip defined by the lamp module has been shown and described, the present invention is not limited in this regard as other ways of retaining the coil spring to the lamp module, such as a clip mounted on the lamp module, may be substituted without departing from the broader aspects of the present invention. Slots 188 defined at the top 190 of the lamp module open sockets 104 hold the wire 174 in abutting relation to the coil spring 100.

It should be understood that the foregoing description is only illustrative of the invention. Various alternatives and modifications can be devised by those skilled in the art without departing from the invention. Accordingly, the present invention encompasses a number of alternatives, modifications and variants that fall within the scope of the appended claims.

What is claimed is:

1. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact; and a lamp module provided in said casing and supported between said base and said casing, said switch cavity defined between said base and said lamp module, said lamp module having at least one clearance opening for receiving said pivotally movable actuator, and said lamp module defining at least one lamp opening for receiving an electric lamp.

2. The switch housing defined by claim 1, wherein said base further comprises:

a bottom wall;

side and end walls having lower edges integrally joined to said bottom wall.

3. The switch housing defined by claim 2, wherein each of said base side walls includes at least one projecting base tab, said casing defining slots alignable with said base tabs for securing said base in assembled relation with said casing.

4. The switch housing defined by claim 2, wherein each of said base end walls includes at least one projecting tab for being received in a slot defined by each of said casing end walls.

5. The switch housing defined by claim 1 wherein said upwardly open cavity of said top wall of said casing is of generally rectangular configuration to receive a generally rectangular rocker, said rocker connected to said actuator, and a seal between said actuator and said top wall for providing environmental isolation for said switch cavity.

6. The switch housing defined by claim 1, wherein said casing has a flange, and each of said casing end walls include integrally formed wings projecting laterally outward of said end walls, one of said wings configured to allow mounting into a switch panel opening in only one orientation.

7. The switch housing defined by claim 1 wherein o-ring seals are provided around the lamp which is mounted in said lamp module for providing environmental isolation of said lamp and of said switch cavity.

8. The switch housing defined by claim 1 further comprising a seal between said base and said lamp module.

9. The switch housing defined by claim 8, wherein said seal comprises a gasket between said base and said lamp module.

10. The switch housing defined by claim 1, wherein said lamp module is generally rectangular and also of a dielectric material, and said lamp module having laterally spaced side walls and opposed end walls integrally connected at their vertical edges to form four corners, and said lamp module having a top wall, said top wall defining a centrally positioned laterally extending bridge, said bridge defining at least one wire channel, said top wall defining said at least one clearance opening for receiving said actuator.

11. The switch housing defined by claim 10, wherein each of said lamp module end walls include protruding wedges, each of said wedges of differing configuration, said casing end walls defining interior wedge shaped slots whereby said lamp module can be assembled with said casing in only one orientation.

12. The switch housing defined by claim 1 wherein said lamp module has integrally formed downwardly open sockets, and upwardly open sockets in said base, and conductive means for electrically connecting said lamp to said terminals in said base, said conductive means provided in part in said lamp module and in part in said base.

13. The switch housing defined by claim 12 wherein said conductive means comprises a coil spring.

14. The switch housing defined by claim 13 wherein said conductive means further comprises conductive clips in said base, said conductive clips for receiving terminals.

15. The switch housing defined by claim 14 wherein said terminals are spade terminals fitted into said conductive clips in said base.

16. The switch housing defined by claim 14 wherein said conductive means electrically connecting said lamp to said terminals in said base further comprises:

at least one wire attached to said lamp; and means for retaining said coil spring in abutting relation to said wire.

17. The switch housing defined by claim 16 wherein the means for retaining includes at least one retaining clip defined by said lamp module, said clip defining a recess for gripping said coil spring.

18. The switch housing defined by claim 16 wherein the means for retaining comprises clip means on said lamp module for receiving an end of said coil spring.

19. The switch housing defined by claim 1, wherein said actuator includes a rocker, said rocker defining a downwardly protruding tab, said casing top wall defining an upwardly protruding tab, whereby said rocker can be assembled with said casing in only one orientation.

20. The switch housing defined by claim 19, wherein said upwardly protruding tab is defined on said center rib portion of said casing and precludes assembly of said rocker in other than said one orientation.

21. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact;

a lamp module provided in said casing and supported between said base and said casing, said lamp module having at least one clearance opening for receiving said pivotally movable actuator, and said lamp module defining at least one lamp opening for receiving an electric lamp; and wherein said casing has a flange, and each of said casing end walls include integrally formed wings projecting laterally outward of said end walls, one of said wings configured to allow mounting into a switch panel opening in only one orientation.

22. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact;

a lamp module provided in said casing and supported between said base and said casing, said lamp module having at least one clearance opening for receiving said pivotally movable actuator, and said lamp module defining at least one lamp opening for receiving an electric lamp; and a seal between said base and said lamp module.

23. The switch housing defined by claim 22, wherein said seal comprises a gasket between said base and said lamp module.

24. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact;

a lamp module provided in said casing and supported between said base and said casing, said lamp module having at least one clearance opening for receiving said pivotally movable actuator, and said lamp module defining at least one lamp opening for receiving an electric lamp; and wherein said lamp module is generally rectangular and also of a dielectric material, and said lamp module having laterally spaced side walls and opposed end walls integrally connected at their vertical edges to form four corners, and said lamp module having a top wall, said top wall defining a centrally positioned laterally extending bridge, said bridge defining at least one wire channel, said top wall defining said at least one clearance opening for receiving said actuator.

25. The switch housing defined by claim 24, wherein each of said lamp module end walls include protruding wedges, each of said wedges of differing configuration, said casing end walls defining interior wedge shaped slots whereby said lamp module can be assembled with said casing in only one orientation.

26. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact;

a lamp module provided in said casing and supported between said base and said casing, said lamp module having at least one clearance opening for receiving said pivotally movable actuator, and said lamp module defining at least one lamp opening for receiving an electric lamp; and wherein said lamp module has integrally formed downwardly open sockets, and upwardly open sockets in said base, and conductive means for electrically connecting said lamp to said terminals in said base, said conductive means provided in part in said lamp module and in part in said base.

27. The switch housing defined by claim 26 wherein said conductive means comprises a coil spring.

28. The switch housing defined by claim 27 wherein said conductive means further comprises conductive clips in said base, said conductive clips for receiving terminals.

29. The switch housing defined by claim 28 wherein said terminals are spade terminals fitted into said conductive clips in said base.

30. The switch housing defined by claim 28 wherein said conductive means electrically connecting said lamp to said terminals in said base further comprises:

at least one wire attached to said lamp; and means for retaining said coil spring in abutting relation to said wire.

31. The switch housing defined by claim 30 wherein the means for retaining includes at least one retaining clip defined by said lamp module, said clip defining a recess for gripping said coil spring.

32. The switch housing defined by claim 30 wherein the means for retaining comprises clip means on said lamp module for receiving an end of said coil spring.

33. An electric switch housing, comprising:

a generally downwardly open rectangular dielectric casing having laterally spaced side walls and opposed end walls integrally connected at their adjacent vertical edges to form four corners, said casing having a top wall including a raised center rib portion, said center rib portion having laterally spaced sockets, said side and end walls having top edges integrally joined to said top wall, said casing defining an integrally formed upwardly open cavity for receiving an actuator;

an actuator pivotally received in said casing and having upper shoulder portions received in said sockets;

a generally upwardly open rectangular dielectric base received in said downwardly open casing, said base, and said casing defining a switch cavity in which is disposed at least two terminals and at least one movable switch contact;

a lamp module provided in said casing and supported between said base and said casing, said lamp module having at least one clearance opening for receiving said pivotally movable actuator, and said lamp module defining at least one lamp opening for receiving an electric lamp; and wherein said actuator includes a rocker, said rocker defining a downwardly protruding tab, said casing top wall defining an upwardly protruding tab, whereby said rocker can be assembled with said casing in only one orientation.

34. The switch housing defined by claim 33, wherein said upwardly protruding tab is defined on said center rib portion of said casing and precludes assembly of said rocker in other than said one orientation.

* * * * *

UNITED STATES PATENT AND TRADEMARK OFFICE

CERTIFICATE OF CORRECTION

PATENT NO. : 6,013,885

DATED : Jan. 11, 2000

INVENTOR(S) : Kowalczyk

It is certified that error appears in the above-identified patent and that said Letters Patent is hereby corrected as shown below:

Column 2, line 18: After "One", insert --wing--.
Column 2, line 27: After "of the casing", delete "34" and insert --12--.
Column 2, line 35: After "locations than", delete "on".
Column 2, line 61: After "Inside", insert --,--.
Column 3, line 9: After "conductive clips", delete "92" and insert --90--.
Column 3, line 13: After "conductive clip", delete "90" and insert --92--.
Column 3, line 15: After "conductive clips", delete "92" and insert --90--.
Column 3, line 28: After "in the base", delete "12" and insert --42--.
Column 3, line 61: After "the rocker", insert --tabs--.
Column 4, line 34: After "also extend", delete "the".
Column 4, lines 50-52: Delete "Slots 188 defined at the top 190 of the lamp module open sockets 104 hold the wire 174 in abutting relation to the coil spring 100." and insert --The retaining means 180 for holding at least one wire 174 in abutting relation to the coil spring 100 include slots 188 defined at the top 190 of the lamp module open sockets 104.--

Signed and Sealed this

Tenth Day of April, 2001

Nicholas P. Godici

*Attest:*

NICHOLAS P. GODICI

*Attesting Officer*

*Acting Director of the United States Patent and Trademark Office*